US005213939A

United States Patent [19]

Sugiyama et al.

[11] Patent Number: 5,213,939

[45] Date of Patent: May 25, 1993

[54] LIGHT- AND HEAT-SENSITIVE RECORDING MATERIAL

[75] Inventors: Takekatsu Sugiyama; Sadao Ishige; Naoto Yanagihara; Hiroshi Kamikawa; Keiichi Tateishi, all of Shizuoka, Japan

[73] Assignee: Fuji Photo Film Co., Ltd., Kanagawa, Japan

[21] Appl. No.: 763,700

[22] Filed: Sep. 23, 1991

[30] Foreign Application Priority Data

| | | | |
|---|---|---|---|
| Sep. 27, 1990 | [JP] | Japan | 2-258537 |
| Oct. 5, 1990 | [JP] | Japan | 2-267588 |
| Oct. 5, 1990 | [JP] | Japan | 2-267589 |
| Nov. 22, 1990 | [JP] | Japan | 2-319751 |

[51] Int. Cl.[5] ..... G03C 1/58

[52] U.S. Cl. ..... 430/138; 430/151; 430/171; 430/183; 430/185; 430/964

[58] Field of Search ..... 430/182, 151, 964, 164, 430/171, 183, 185, 186, 349, 351, 353, 354, 138

[56] References Cited

U.S. PATENT DOCUMENTS

| | | | |
|---|---|---|---|
| 2,500,099 | 3/1950 | Straley | 430/182 |
| 2,915,396 | 12/1959 | Straw | 430/182 |
| 4,590,263 | 5/1986 | Desjarlais et al. | 430/182 |
| 4,842,979 | 6/1989 | Ishige et al. | 430/151 |

*Primary Examiner*—Charles L. Bowers, Jr.
*Assistant Examiner*—Mark F. Huff
*Attorney, Agent, or Firm*—Sughrue, Mion, Zinn, Macpeak & Seas

[57] ABSTRACT

A light- and heat-sensitive recording material is disclosed which includes a support having thereon a recording layer containing a diazo compound, a coupling component, and an organic base compound, wherein the diazo compound is a 1-substituted amino-3-alkoxybenzene-4-diazonium salt and the coupling component is a compound prepared from any of cyclohexane-1,3-dione, 3-cyclohexenone, or 2-cyclohexenone. The light- and heat-sensitive recording material according to the present invention can develop an excellent magenta color hue and has excellent storage properties before recording use (shelf life).

19 Claims, No Drawings

LIGHT- AND HEAT-SENSITIVE RECORDING MATERIAL

FIELD OF THE INVENTION

This invention relates to recording materials in which the light-sensitivity of diazo compounds (diazonium salts) is utilized. More particularly, it relates to a magenta color developing type light- and heat-sensitive recording material.

BACKGROUND OF THE INVENTION

Recording materials in which the light-sensitivity of diazo compounds is utilized are roughly divided into three types. One of these types is known as a wet developing type recording material, in which a support is laminated with a sensitive layer containing a diazo compound and a coupling component as the main components. In this case, an original is superposed on the recording material and, after exposure, development is carried out in an alkali solution. The second type of recording material is known as a dry developing type, in which, unlike the first type, development is carried out with ammonia gas. The third type of recording material is known as a heat developing type, which is further divided into several sub-types, such as: a type in which its sensitive layer contains an ammonia gas generating agent like urea that generates ammonia gas when exposed to heat; a type in which its sensitive layer contains an alkali salt of an acid such as trichloroacetic acid that loses its property as an acid when exposed to heat; and a type in which a higher fatty acid amide is used as a coloring auxiliary, and a diazo compound and a coupling component are activated by heat melting, etc.

Because of the use of a developing solution, the wet developing type material has several disadvantages, such as problems from a maintenance point of view due to the troublesome steps needed for supplementing and discharging the solution, the necessity of large scale equipment and the like, as well as the production of a moist recording material just after copying which requires time to dry for writing.

The dry developing type material also has some problems. For example, it requires that the developing solution to be replenished, by analogy with that with a wet developing type. Also, it requires a gas absorption apparatus to absorb generated ammonia gas, thereby increasing the overall size of the instrument. In addition, it produces an ammonia smell immediately after copying.

On the other hand, unlike the cases of the wet and dry developing types, the heat developing type recording material has an advantage from maintenance point of view because it does not require a developing solution. The prior art heat developing type material, however, requires the use of expensive instrumentation, because it requires a high developing temperature of from 150° to 200° C. Moreover, it is necessary to control the temperature within about ±10° C. to prevent under-development and color tone changes. In addition, because of such a high developing temperature, the diazo compound to be employed in the material should have a high heat resistance. These heat-resistant compounds, however, are disadvantageous in many cases from the viewpoint of the formation of a high color density.

Many attempts have been made to produce a low temperature development system (90° to 130° C.), but these attempts have suffered from the disadvantage of lowered shelf life of the recording material. Consequently, in spite of its advantage from a maintenance point of view when compared to the wet developing type and the dry developing type, the heat developing type recording material has not yet been used as a main diazonium-based recording system.

For the purpose of obtaining a desired color density by heating a recording material comprising a support having thereon a sensitive layer containing a diazo compound and a coupling component, it is necessary to develop the color quickly by the rapid melting, dispersion and reaction of the components when heated. For this purpose, it is preferable that the reaction system be under a basic condition, because such a condition has the effect of enhancing the reaction. Consequently, it is essential to include a basic compound in a coating layer for the purpose of preparing a light- and heat-sensitive recording material having a recording speed increased to such an extent as not to impede seriously its practical use by low temperature heating.

Another essential factor for a light- and heat-sensitive recording material is to prevent coloring on the surface of the material during storage before copying and to prevent a decrease in the developed color density.

In order to prepare a light- and heat-sensitive recording material having such a good shelf life and a quick recording speed, several attempts have been made as described above, but with no practical results.

When a recording material is designed in such a manner that sufficient color development with a high color density can be obtained at a low heating temperature, it is very likely that a coloring reaction occurs even during storage of the material at room temperature prior to its copying. Such a reaction causes coloring on the surface of the recording material, which should be maintained white until its use. Such a coloring problem is especially serious in the case of a red (magenta) color developing type recording material, because even a slight coloring on the surface (fog) becomes visible due to the high visual sensitivity of the color.

With the aim of overcoming such seemingly incompatible problems, the inventors of the present invention have conducted intensive studies and found that the formation of fog can be prevented by preparing a recording material comprising a support having thereon a thermally developable sensitive layer containing a diazo compound, a coupling component, and a basic compound, wherein the diazo compound is included in microcapsules. The inventors have further continued their studies in terms of screening basic compounds, processes for the preparation of microcapsules, and the like, and have succeeded in preventing coloring on the surface of the recording material during storage before copying, as has been disclosed in JP-A-2-54251 (the term "JP-A" as used herein means an "unexamined published Japanese patent application"). As additional background for the present invention, the present inventors have also conducted studies on improvement of the storage stability and oil soluble property of coupling components and found that specific coupling components have excellent properties (U.S. patent application Ser. No. 07/718,476). The present inventors have further conducted intensive studies on the combination of the diazo compound with coupling components and found that a magenta color having a markedly excellent hue can be formed when the specific diazo compound is used in combination with a coupling component selected from the group consisting of the cyclohexane- 1,3-dione derivatives disclosed in the aforementioned patent publication (JP-A-2-54251), the 3-cyclohexenone derivatives, and the 2-cyclohexenone derivatives. The present invention has been accomplished as a result of these efforts.

SUMMARY OF THE INVENTION

A primary object of the present invention is to provide a light- and heat-sensitive recording material which develops an excellent magenta color hue by the combined use of a specific diazo compound and a specific coupling component.

A second object of the present invention is to provide a light- and heat-sensitive recording material having excellent properties with respect to storage before recording use (shelf life).

The above objects of the present invention are accomplished by a light- and heat-sensitive recording material comprising a support having thereon a recording layer comprising a 1-substituted amino-3-alkoxybenzene-4-diazonium salt, a coupling component selected from the group consisting of compounds prepared from any of cyclohexane-1,3-dione, 3-cyclohexenone, and 2-cyclohexenone, and an organic base.

DETAILED DESCRIPTION OF THE INVENTION

A compound represented by the following formula (I) may be used preferably as the diazo compound in the present invention:

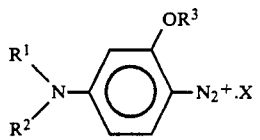

(I)

wherein $R^1$, $R^2$ and $R^3$ are the same or different and are selected from unsubstituted or substituted alkyl, aralkyl and aryl groups, and $X^-$ is an acid anion.

When $R^1$, $R^2$ and $R^3$ in formula (I) contain a substituent, the substituent may be selected from alkyl, aralkyl, aryl, hydroxyl, alkyloxy, aryloxy, alkylthio, arylthio, acyl, alkoxycarbonyl, acyloxy, carbamoyl, acylamino, cyano and like groups and halogen atoms, etc., more preferably, alkyl, aralkyl, aryl, alkoxy, alkoxycarbonyl, acyloxy, carbamoyl, acylamino, acyl, and hydroxyl groups and halogen atoms.

From an oil soluble property point of view, the total number of carbon atoms of $R^1$, $R^2$, and $R^3$ may preferably be 12 or higher, more preferably 14 or higher.

Illustrative examples of the acid anion represented by $X^-$ in formula (I) include, for instance, $C_n F_{2n+1} COOH$ (n is an integer of from 1 to 9), $C_m F_{2m+1} SO_3H$ (m is an integer of from 1 to 9), boron tetrafluoride, tetraphenylboron, hexafluorophosphate, an aromatic carboxylic acid, and an aromatic sulfonic acid, as well as complex compounds thereof which are prepared using zinc chloride, cadmium chloride, stannic chloride, and the like to stabilize the diazonium salt. Among these acid anions, $[PF_6^-]$, $[BF_4^-]$, and $[Cl \cdot \frac{1}{2} ZnCl_2]$ are more preferable.

The diazo compound eligible for use in the present invention may preferably have a melting point of from about 30° to 200° C., and from a handling point of view, more preferably from about 50° to 150° C.

The diazo compound is dissolved in an appropriate solvent (tricresyl phosphate, for example) when it is included in microcapsules. Thus, the diazo compound may preferably have an appropriately high solubility in such a solvent and a low solubility in water. Illustratively, the diazo compound may preferably have a solubility of about 5% or more, more preferably, about 7% or more in said solvent and a solubility of about 1% or less, more preferably, about 0.5% or less in water.

The diazo compound of the present invention may be used in a heat-sensitive recording layer preferably in an amount of from about 0.02 to 3 g/m², more preferably in the range of from about 0.1 to 2 g/m² from a viewpoint of color density.

The following shows illustrative examples of the diazo compound of the present invention, but not by way of limitation.

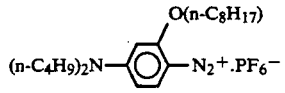

(A)

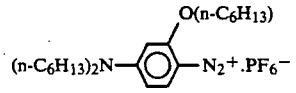

(B)

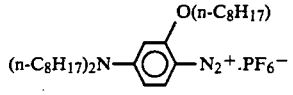

(C)

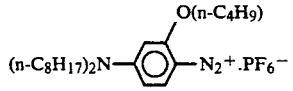

(D)

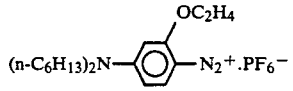

(E)

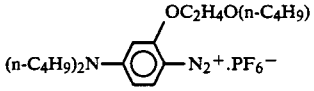

(F)

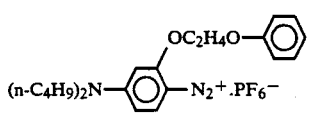

(G)

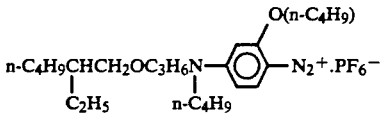

(H)

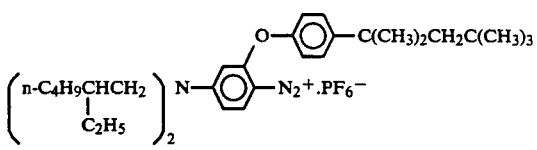

(I)

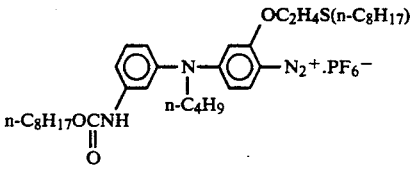

(J)

-continued

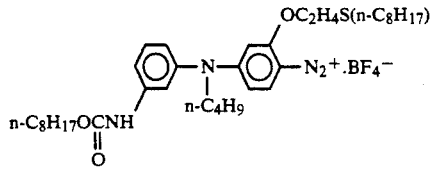

(K)

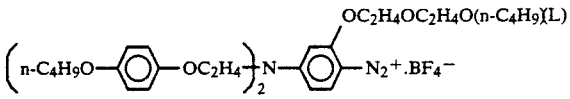

(L)

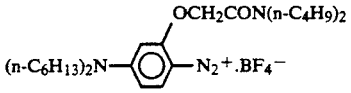

(M)

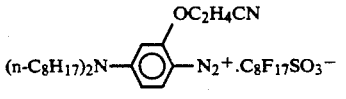

(N)

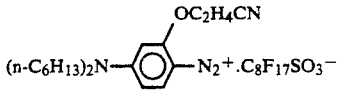

(O)

Diazo compounds of the present invention may be used alone or as a mixture of two or more.

In addition, the diazo compound of the present invention may be used in combination with a known prior art diazo compound according to various objects, such as adjustment of hue.

Preferred diazo compounds which can be used jointly may include 4-diazo-1-dimethylaminobenzene, 4-diazo-2-butoxy-5-chloro-1-dimethylaminobenzene, 4-diazo-1-methylbenzylaminobenzene, 4-diazo-1-ethylhydroxyethylaminobenzene, 4-diazo-1-morpholinobenzene, 4-diazo-1-morpholino-2,5-dibutoxybenzene, 4-diazo-1-toluylmercapto-2,5-diethoxybenzene, 4-diazo-1-piperazino-2-methoxy-5-chlorobenzene, 4-diazo-1-(N,N-dioctylaminocarbonyl)benzene, 4-diazo-1-(4-tertoctylphenoxy)benzene, 4-diazo-1-(2-ethylhexanoylpiperidino)-2,5-dibuthoxybenzene, 4-diazo-1-(2,5-di-tert-amylphenoxy-α-butanoylpiperidino)benzene, 4-diazo-1-(4-methoxy)phenylthio-2,5-diethoxybenzene, 4-diazo-1-(4-methoxy)benzamide-2,5-diethoxybenzene, and 4-diazo-1-pyrrolidino-2-methoxybenzene.

Illustrative examples of acid compounds which form diazonium salts with the just described jointly usable diazo compounds include, for instance, $C_n F_{2n+1} COOH$ (n is an integer of from 1 to 9), $C_m F_{2m+1} SO_3H$ (m is an integer of from 1 to 9), boron tetrafluoride, tetraphenylboron, hexafluorophosphate, an aromatic carboxylic acid, and an aromatic sulfonic acid, as well as complex compounds thereof which are prepared using zinc chloride, cadmium chloride, stannic chloride, and the like to stabilize the diazonium salt.

With regard to the cyclohexane-1,3-dione derivatives of the present invention, a derivative in which the 4-position is substituted by an electron attracting group such as a substituted carbonyl group or a cyano group or by a hydrogen atom may be used preferably, because such a derivative can be synthesized easily, and materials for its synthesis can be obtained easily.

A compound represented by the following formula (II) may be used preferably as the cyclohexane-1,3-dione derivative of the present invention:

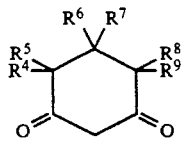

(II)

wherein $R^4$ is any one of a hydrogen atom, a substituted carbonyl group and a cyano group; and $R^5$, $R^6$, $R^7$, $R^8$ and $R^9$ are the same or different and are selected from a hydrogen atom, a halogen atom, an alkyl group, an aryl group, an aralkyl group, a substituted amino group, a substituted carbonyl group, and a cyano group.

When $R^4$ is a substituted carbonyl group, alkyl, aralkyl, and alkoxy groups are exemplified as the substituent. When $R^5$, $R^6$, $R^7$, $R^8$ or $R^9$ is a substituted amino group, alkyl, aralkyl, aryl, acyl, and sulfonyl groups are exemplified as the substituent. When $R^5$, $R^6$, $R^7$, $R^8$ or $R^9$ is a substituted carbonyl group, alkyl, aralkyl, aryl, alkoxy, and amino groups are exemplified as the substituent.

Preferred substituents represented by $R^4$ in formula (II) are a hydrogen atom, an alkoxycarbonyl group having 2 to 25 carbon atoms, an alkylcarbonyl group having 2 to 25 carbon atoms, an arylcarbonyl group having 7 to 30 carbon atoms, and a cyano group, of which a hydrogen atom, an alkoxycarbonyl group having 2 to 15 carbon atoms, and a cyano group are particularly preferred.

Preferred substituents represented by $R^5$, $R^6$, $R^7$, $R^8$ and $R^9$ in formula (II) are a hydrogen atom, a halogen atom, an alkyl group having 1 to 20 carbon atoms, an aryl group having 6 to 25 carbon atoms, an aralkyl group having 7 to 25 carbon atoms, and a substituted amino group. These groups may be substituted by substituents such as an alkyl group, an aryl group, a hydroxyl group, an alkyloxy group, an aryloxy group, an alkylthio group, an arylthio group, an acyl group, an alkoxycarbonyl group, an acyloxy group, a carbamoyl group, an acylamino group, a halogen atom, a cyano group, and the like. When the substituents represented by $R^5$, $R^6$, $R^7$, $R^8$ and $R^9$ are substituted amino groups, a dialkylamino group having 2 to 30 carbon atoms and an acylamino group having 2 to 30 carbon atoms may be used preferably. Each pair of $R^4$ and $R^5$, $R^5$ and $R^6$, $R^6$ and $R^7$, $R^7$ and $R^8$ and $R^8$ and $R^9$ may be made into a ring containing a hetero atom.

The following shows illustrative examples of the coupling component of the present invention, but not by way of limitation.

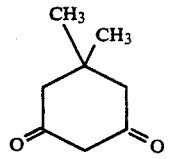

(II-1)

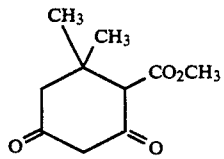

(II-2)

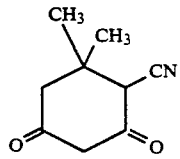

(II-3)

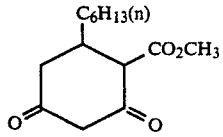

(II-4)

-continued
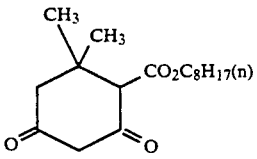
(II-5)
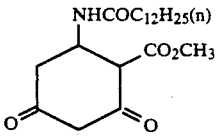
(II-6)
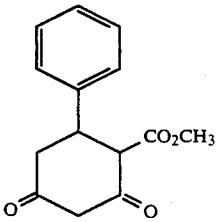
(II-7)
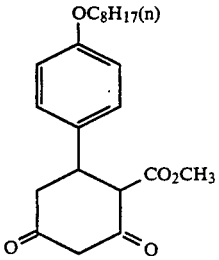
(II-8)
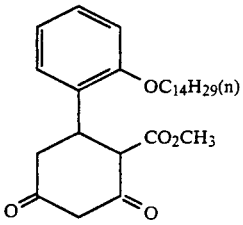
(II-9)
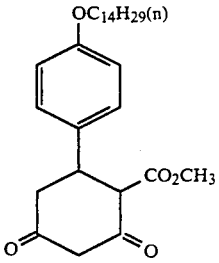
(II-10)
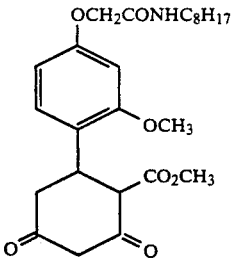
(II-11)
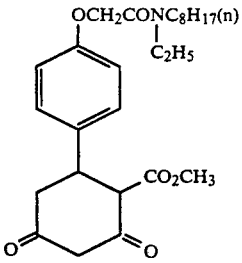
(II-12)
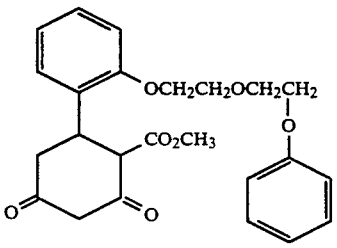
(II-13)
-continued
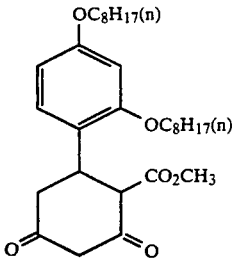
(II-14)
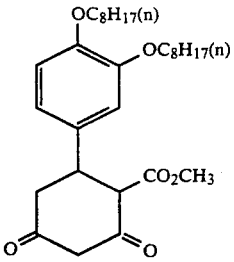
(II-15)
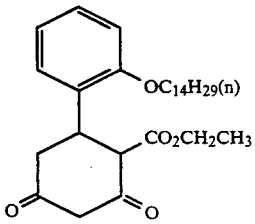
(II-16)
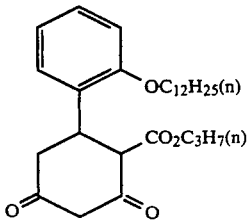
(II-17)
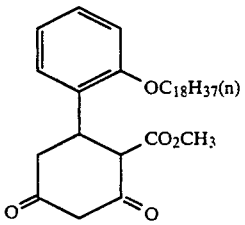
(II-18)
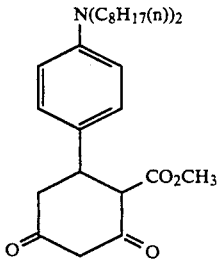
(II-19)
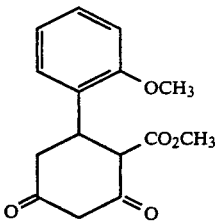
(II-20)
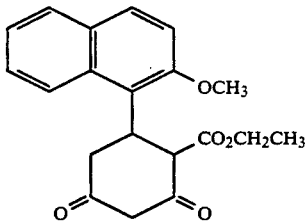
(II-21)
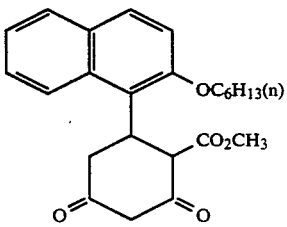
(II-22)

-continued

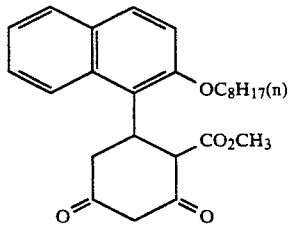

(II-23)

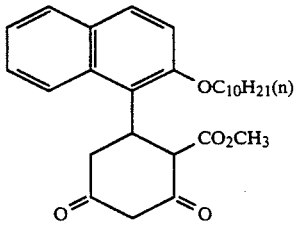

(II-24)

The 3-cyclohexenone derivative of the present invention may preferably have a substituent group at the 3-position, which is bonded via a hetero atom such as oxygen, nitrogen, sulfur, or the like. Most preferably, such a derivative may have a substituent group at the 3-position bonded via oxygen atom.

With regard to the 3-cyclohexenone derivatives of the present invention, a derivative in which the 4-position is substituted by an electron attracting group such as a substituted carbonyl group or a cyano group may be used preferably, because such a derivative can be synthesized easily, and materials for its synthesis can be obtained easily.

The 3-cyclohexenone derivative of the present invention may contain an isomerized form of the derivative in which the double bond at the 3-position is isomerized to the 2-position by the tautomerism of the derivative itself. When the substituent at the 4-position is an electron attracting group, such an isomerization may be infrequent.

A compound represented by the following formula (III) may be used preferably as the 3-cyclohexenone derivative of the present invention:

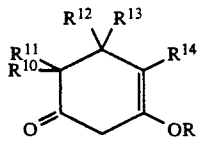

(III)

wherein $R^{10}$, $R^{11}$, $R^{12}$ and $R^{13}$ are the same or different and are selected from a hydrogen atom, an alkyl group, an aryl group, an aralkyl group, a substituted amino group, a substituted carbonyl group, and a cyano group; $R^{14}$ is a substituted carbonyl group or a cyano group; and R is an alkyl group, an aryl group, a substituted carbonyl group, a substituted sulfonyl group, a cationic group, or a substituted silyl group.

When $R^{14}$ is a substituted carbonyl group, alkyl, aralkyl, and alkoxy groups are exemplified as the substituent. When $R^{10}$, $R^{11}$, $R^{12}$ or $R^{13}$ is a substituted amino group, alkyl, aralkyl, aryl, acyl, and sulfonyl groups are exemplified as the substituent. When $R^{10}$, $R^{11}$, $R^{12}$ or $R^{13}$ is a substituted carbonyl group, alkyl, aralkyl, aryl, alkoxy, and amino groups are exemplified as the substituent.

Preferred substituents as represented by $R^{10}$, $R^{11}$, $R^{12}$ and $R^{13}$ in formula (III) are a hydrogen atom, an alkyl group having 1 to 10 carbon atoms, an aryl group having 6 to 20 carbon atoms, an alkoxycarbonyl group having 2 to 25 carbon atoms, an alkylcarbonyl group having 2 to 25 carbon atoms, an arylcarbonyl group having 7 to 35 carbon atoms, and a cyano group.

Among the groups represented by $R^{14}$, at least one group may preferably be selected from an alkoxycarbonyl group having 2 to 25 carbon atoms, an alkylcarbonyl group having 2 to 25 carbon atoms, an arylcarbonyl group having 7 to 30 carbon atoms, and a cyano group.

Each pair of $R^{10}$ and $R^{11}$, $R^{11}$ and $R^{12}$, $R^{12}$ and $R^{13}$, $R^{13}$ and $R^{14}$, and $R^{14}$ and R may be made into a ring containing a hetero atom.

The group represented by R in formula (III) may further contain a substituent. When R is an alkyl group, an aryl group, a substituted carbonyl group, or a substituted sulfonyl group, such an additional substituent may be selected preferably from a halogen atom, an alkyl group, an aryl group, an alkoxy group, a substituted carbonyl group, a substituted amino group, and a heterocyclic group. When R is a substituted silyl group, an alkyl group or an aryl group may be used preferably. These substituent groups may further contain other substituent groups.

When the group as represented by R in formula (III) is a cationic group, the 3-cyclohexenone derivative of the present invention becomes a salt. In this instance, an alkali metal salt, an alkaline earth metal salt, an ammonium salt, and the like are preferable.

Preferred examples of R include an alkyl group having 1 to 20 carbon atoms, an aryl group having 6 to 30 carbon atoms, an alkylcarbonyl group having 2 to 20 carbon atoms, an arylcarbonyl group having 7 to 20 carbon atoms, an alkylsulfonyl group having 2 to 20 carbon atoms, an arylsulfonyl group having 7 to 20 carbon atoms, an alkoxycarbonyl group having 2 to 20 carbon atoms, a substituted carbamoyl group having 2 to 20 carbon atoms, and a quaternary ammonium cation having 4 to 40 carbon atoms, more preferably, an alkylcarbonyl group having 2 to 15 carbon atoms, an arylcarbonyl group having 7 to 15 carbon atoms, an alkoxycarbonyl group having 2 to 15 carbon atoms, and a substituted carbamoyl group having 2 to 15 carbon atoms. Among these groups, a substituted carbonyl group is particularly preferable as R. As the substituent, a lower alkyl group and a lower alkoxy group are preferable.

The following shows illustrative examples of the coupling component of the present invention, but not by way of limitation.

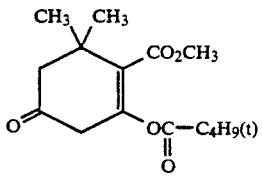

(III-1)

-continued
(III-2)
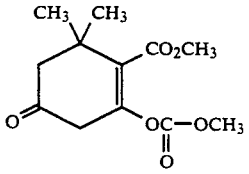
(III-3)
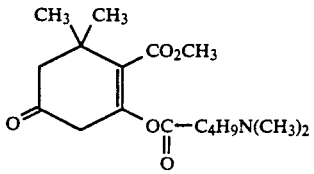
(III-4)
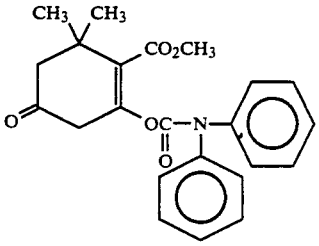
(III-5)
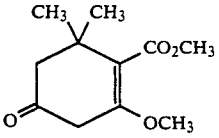
(III-6)
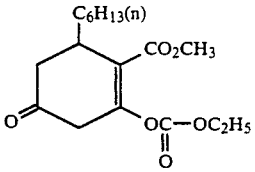
(III-7)
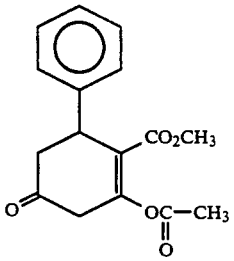
(III-8)
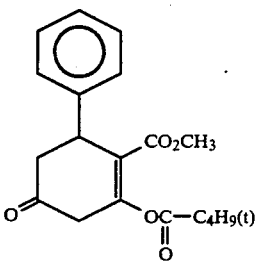
-continued
(III-9)
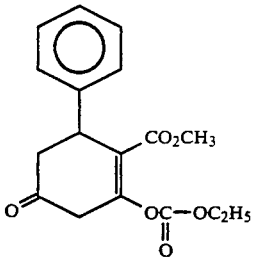
(III-10)
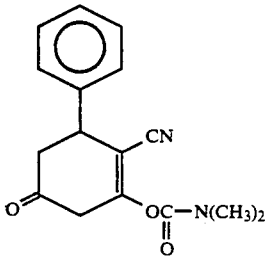
(III-11)
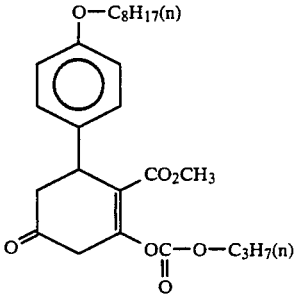
(III-12)
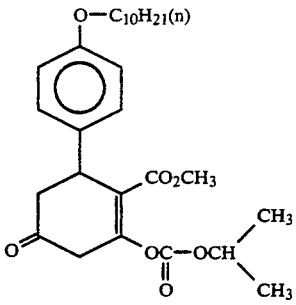
(III-13)
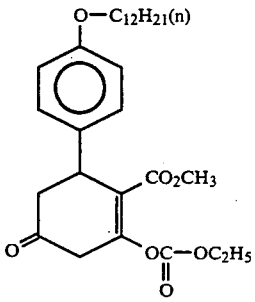

-continued (III-14)

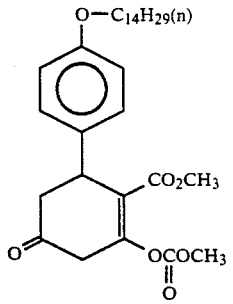

(III-15)

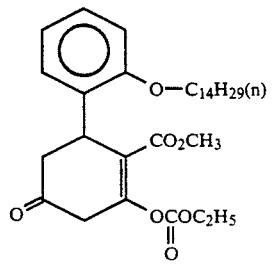

(III-16)

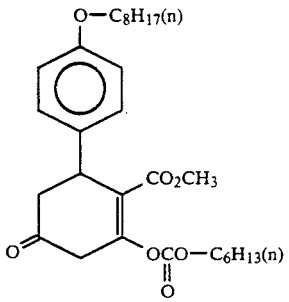

(III-17)

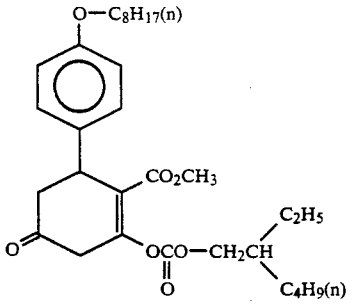

(III-18)

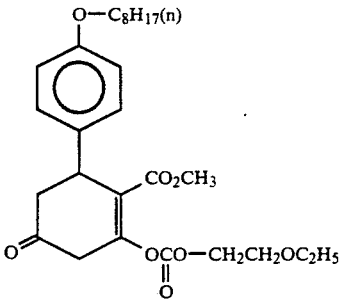

-continued

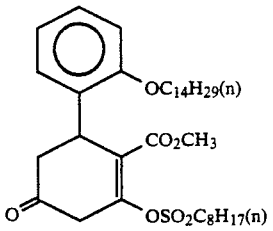

(III-20)

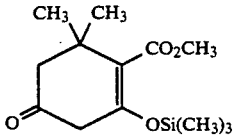

The 2-cyclohexenone derivative of the present invention may preferably have a substituent group at the 3-position, which is bonded via a hetero atom such as oxygen, nitrogen, sulfur, or the like, from a viewpoint of its coupling activity with the diazo compound. Most preferably, such a derivative may have a substituent group at the 3-position bonded via oxygen atom.

With regard to the 2-cyclohexenone derivatives of the present invention, a derivative in which the 4- or 6-position is substituted by an electron attracting group such as a substituted carbonyl group or a cyano group may be used preferably, because such a derivative can be synthesized easily and materials for its synthesis can be obtained easily.

The 2-cyclohexenone derivative of the present invention may contain an isomerized form of the derivative in which the double bond at the 2-position is isomerized to the 3-position by the tautomerism of the derivative itself. When the substituent at the 4-position is an electron attracting group, such an isomerization may be infrequent.

A compound represented by the following formula (IV) may be used preferably as the 2-cyclohexenone derivative in which the 4-position is substituted by an electron attracting group:

(IV)

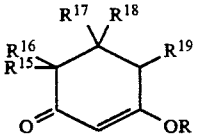

wherein $R^{15}$, $R^{16}$, $R^{17}$ and $R^{18}$ are the same or different and are selected from a hydrogen atom, an alkyl group, an aryl group, an aralkyl group, a substituted amino group, a substituted carbonyl group, and a cyano group; $R^{19}$ is a substituted carbonyl group or a cyano group; and R is an alkyl group, an aryl group, a substituted carbonyl group, a substituted sulfonyl group, a cationic group, or a substituted silyl group.

When $R^{19}$ is a substituted carbonyl group, alkyl, aralkyl, and alkoxy groups are exemplified as the substituent. When $R^{15}$, $R^{16}$, $R^{17}$ or $R^{18}$ is a substituted amino group, alkyl, aralkyl, aryl, acyl, and sulfonyl groups are exemplified as the group, alkyl, aralkyl, aryl, alkoxy, and amino groups are exemplified as the substituent.

Preferred substituents represented by $R^{15}$, $R^{16}$, $R^{17}$ and $R^{18}$ in formula (IV) are a hydrogen atom, an alkyl group having 1 to 10 carbon atoms, an aryl group having 6 to 20 carbon atoms, an alkoxycarbonyl group having 2 to 25 carbon atoms, an alkylcarbonyl group having 2 to 25 carbon atoms, an arylcarbonyl group having 7 to 35 carbon atoms, and a cyano group.

Among groups represented by $R^{19}$, at least one group may preferably be selected from an alkoxycarbonyl group having 2 to 25 carbon atoms, an alkylcarbonyl group having 2 to 25 carbon atoms, an arylcarbonyl group having 7 to 30 carbon atoms, and a cyano group.

Each pair of $R^{15}$ and $R^{16}$, $R^{16}$ and $R^{17}$, $R^{17}$ and $R^{18}$, $R^{18}$ and $R^{19}$, and $R^{19}$ and R may be made into a ring containing a hetero atom.

The group represented by R in formula (IV) may further contain a substituent. When R is an alkyl group, an aryl group, a substituted carbonyl group, or a substituted sulfonyl group, such an additional substituent may be selected preferably from a halogen atom, an alkyl group, an aryl group, an alkoxy group, a substituted carbonyl group, a substituted amino group, and a heterocyclic group. When R is a substituted silyl group, an alkyl group or an aryl group may be used preferably. These substituent groups may further contain another substituent groups.

When the group as represented by R in formula (IV) is a cationic group, the 2-cyclohexenone derivative of the present invention becomes a salt. In this instance, an alkali metal salt, an alkaline earth metal salt, an ammonium salt, and the like are preferable.

Preferred examples of R include an alkyl group having 1 to 20 carbon atoms, an aryl group having 6 to 30 carbon atoms, an alkylcarbonyl group having 2 to 20 carbon atoms, an arylcarbonyl group having 7 to 20 carbon atoms, an alkylsulfonyl group having 2 to 20 carbon atoms, an arylsulfonyl group having 7 to 20 carbon atoms, an alkoxycarbonyl group having 2 to 20 carbon atoms, a substituted carbamoyl group having 2 to 20 carbon atoms, and a quaternary ammonium cation having 4 to 40 carbon atoms, more preferably, an alkylcarbonyl group having 2 to 15 carbon atoms, an arylcarbonyl group having 7 to 15 carbon atoms, an alkoxycarbonyl group having 2 to 15 carbon atoms, and a substituted carbamoyl group having 2 to 15 carbon atoms. Among these groups, a substituted carbonyl group is particularly preferable as R. As the substituent, a lower alkyl group and a lower alkoxy group are preferable.

The following shows illustrative examples of the coupling component of the present invention, but not by way of limitation.

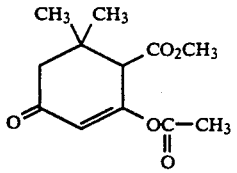

(IV-1)

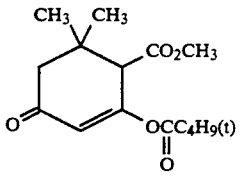

(IV-2)

-continued

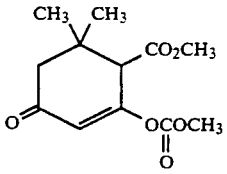

(IV-3)

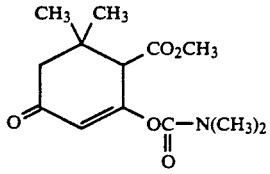

(IV-4)

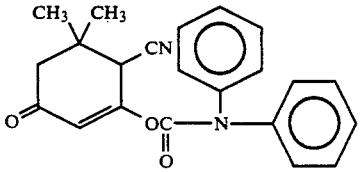

(IV-5)

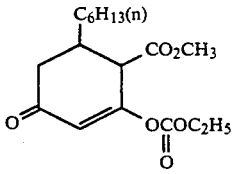

(IV-6)

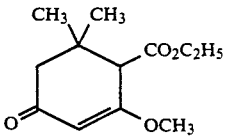

(IV-7)

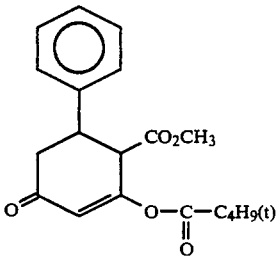

(IV-8)

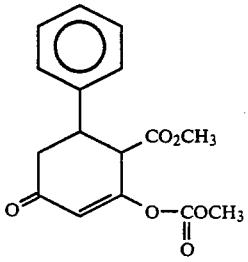

(IV-9)

-continued (IV-10)

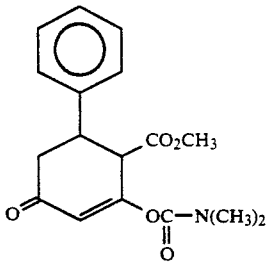

(IV-11)

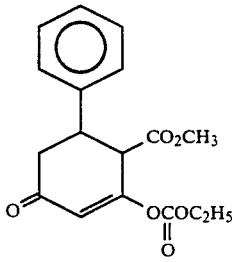

(IV-12)

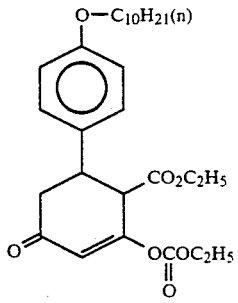

(IV-13)

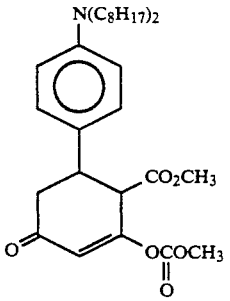

(IV-14)

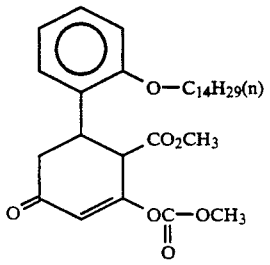

-continued (IV-15)

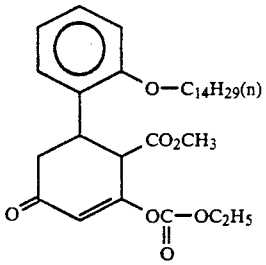

(IV-16)

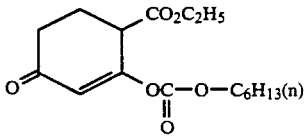

(IV-17)

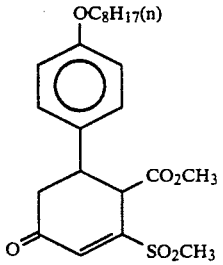

(IV-18)

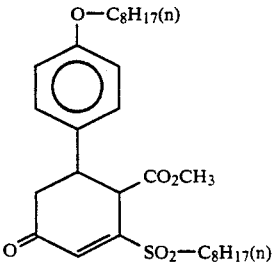

(IV-19)

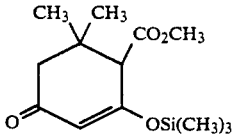

(IV-20)

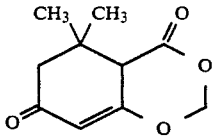

A compound represented by the following formula (V) may be used preferably as the 2-cyclohexenone derivative in which the 6-position is substituted by an electron attracting group, and the 2-cyclohexenone derivative of the present invention may be represented by tautomers of formula (V). The tautomers are represented by the following formulae (VI) and (VII):

(V)

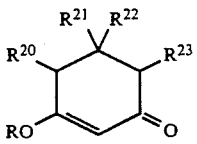

-continued (VI)

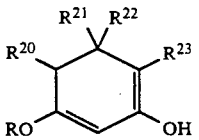

(VII)

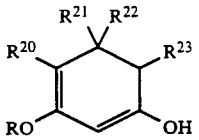

wherein $R^{20}$, $R^{21}$, and $R^{22}$ are the same or different and are selected from a hydrogen atom, an alkyl group, an aryl group, an aralkyl group, a substituted amino group, a substituted carbonyl group, and a cyano group; $R^{23}$ is a substituted carbonyl group or a cyano group; and R is an alkyl group, an aryl group, a substituted carbonyl group, a substituted sulfonyl group a cationic group, or a substituted silyl group.

When $R^{23}$ is a substituted carbonyl group, alkyl, aralkyl, and alkoxy groups are exemplified as the substituent. When $R^{20}$, $R^{21}$ or $R^{22}$ is a substituted amino group, alkyl, aralkyl, aryl, acyl, and sulfonyl groups are exemplified as the substituent. When $R^{20}$, $R^{21}$ or $R^{22}$ is a substituted carbonyl group, alkyl, aralkyl, aryl, alkoxy, and amino groups are exemplified as the substituent.

Preferred substituents as represented by $R^{20}$, $R^{21}$, and $R^{22}$ in formula (V) are a hydrogen atom, an alkyl group having 1 to 10 carbon atoms, an aryl group having 6 to 20 carbon atoms, an alkoxycarbonyl group having 2 to 25 carbon atoms, an alkylcarbonyl group having 2 to 25 carbon atoms, an arylcarbonyl group having 7 to 35 carbon atoms, and a cyano group.

With regard to the group represented by $R^{23}$, an alkoxycarbonyl group having 2 to 25 carbon atoms, an alkylcarbonyl group having 2 to 25 carbon atoms, an arylcarbonyl group having 7 to 30 carbon atoms, and a cyano group may be used preferably.

Each pair of R and $R^{20}$, $R^{20}$ and $R^{21}$, $R^{21}$ and $R^{22}$, and $R^{22}$ and $R^{23}$ may be made into a ring containing a hetero atom.

The group represented by R in formula (V) may further contain a substituent. When R is an alkyl group, an aryl group, a substituted carbonyl group, or a substituted sulfonyl group, such an additional substituent may be selected preferably from a halogen atom, an alkyl group, an aryl group, an alkoxy group, a substituted carbonyl group, a substituted amino group, and a heterocyclic group. When R is a substituted silyl group, an alkyl group or an aryl group may be used preferably. These substituent groups may further contain other substituent groups.

When the group as represented by R in formula (V) is a cationic group, the 2-cyclohexenone derivative of the present invention becomes a salt. In this instance, an alkali metal salt, an alkaline earth metal salt, an ammonium salt, and the like are preferable.

Preferred examples of R include an alkyl group having 1 to 20 carbon atoms, an aryl group having 6 to 30 carbon atoms, an alkylcarbonyl group having 2 to 20 carbon atoms, an arylcarbonyl group having 7 to 20 carbon atoms, an alkylsulfonyl group having 2 to 20 carbon atoms, an arylsulfonyl group having 7 to 20 carbon atoms, an alkoxycarbonyl group having 2 to 20 carbon atoms, a substituted carbamoyl group having 2 to 20 carbon atoms, and a quaternary ammonium cation having 4 to 40 carbon atoms, more preferably, an alkylcarbonyl group having 2 to 15 carbon atoms, an arylcarbonyl group having 7 to 15 carbon atoms, an alkoxycarbonyl group having 2 to 15 carbon atoms, and a substituted carbamoyl group having 2 to 15 carbon atoms. Among these groups, a substituted carbonyl group is particularly preferable as R. As the substituent, a lower alkyl group and a lower alkoxy group are preferable.

The 2-cyclohexenone derivative of the present invention can be obtained easily by esterifying a cyclohexane-1,3-dione derivative.

The esterification may be effected, for example, by (1) reacting a cyclohexane-1,3-dione derivative with a carboxylic acid halide under a basic condition, or (2) reacting a cyclohexane-1,3-dione derivative with a carboxylic acid under an acidic condition. Procedure (1) is particularly preferred because of the mild reaction.

The following shows illustrative examples of the coupling component of the present invention, but not by way of limitation.

(V-1)

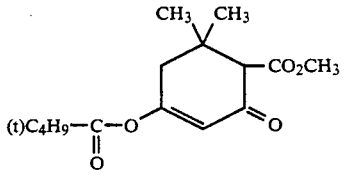

(V-2)

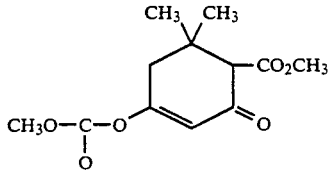

(V-3)

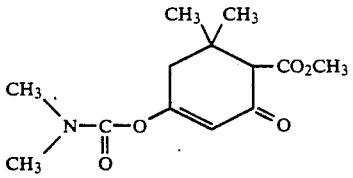

(V-4)

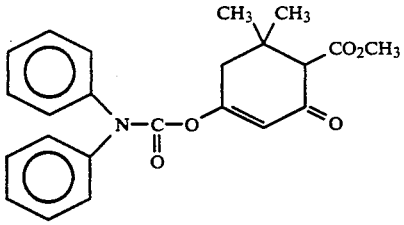

(V-5)

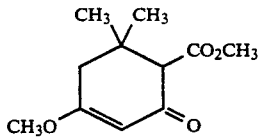

(V-6)

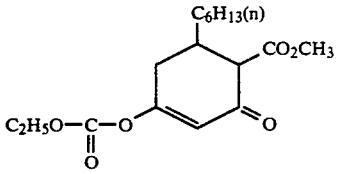

-continued
(V-7)
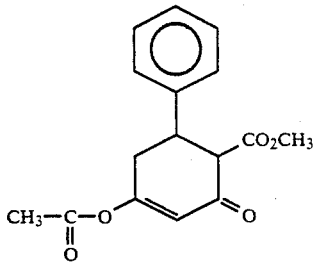
(V-8)
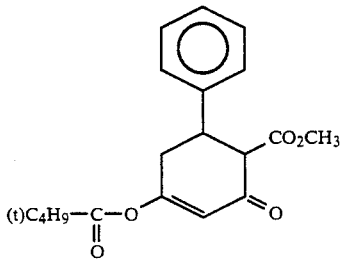
(V-9)
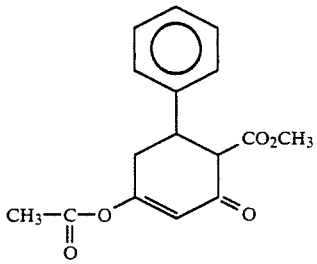
(V-10)
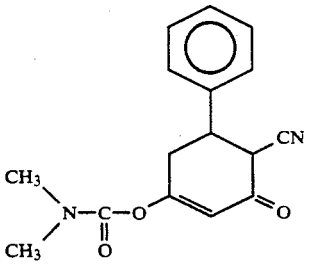
(V-11)
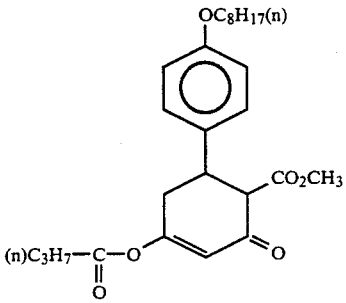
-continued
(V-12)
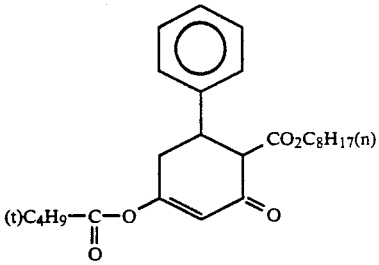
(V-13)
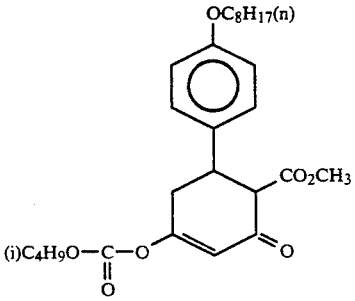
(V-14)
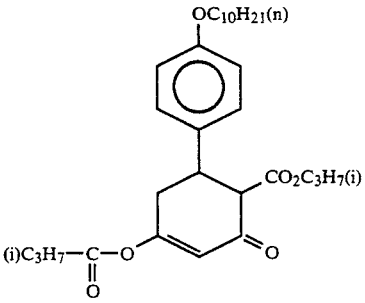
(V-15)
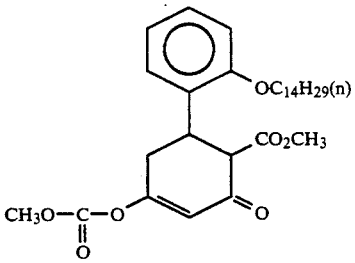
(V-16)
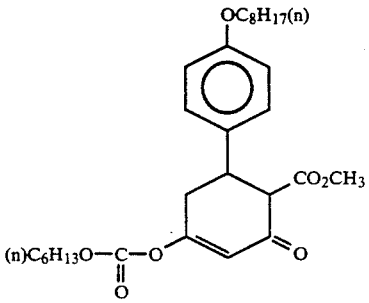

-continued (V-17)

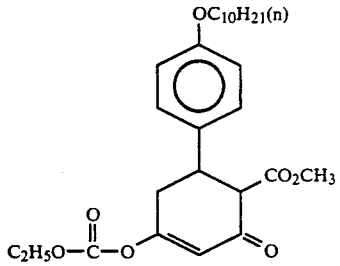

(V-18)

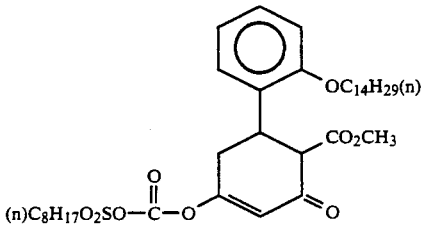

(V-19)

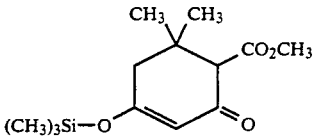

(V-20)

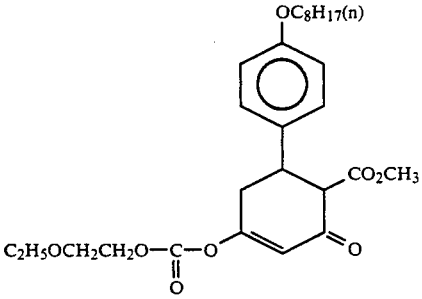

(V-21)

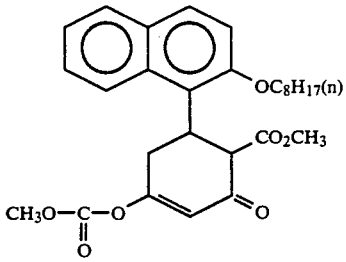

(V-22)

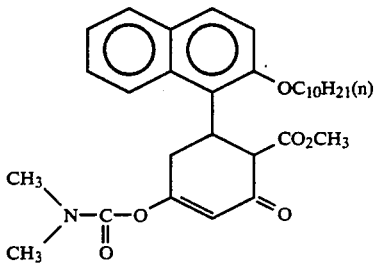

-continued (V-23)

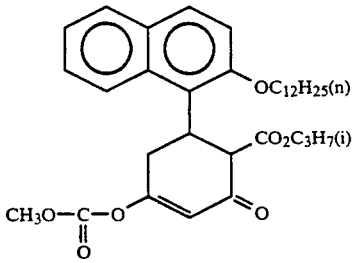

(V-24)

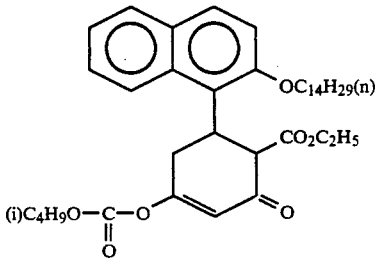

(V-25)

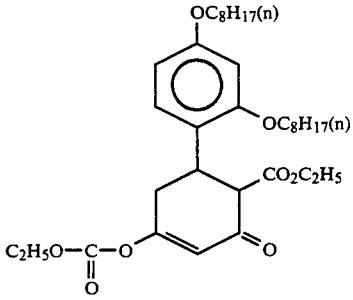

(V-26)

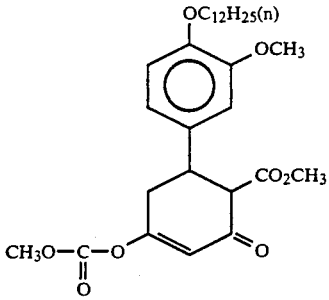

Coupling components of the present invention may be used alone or as a mixture of two or more.

In addition, the additional coupling component may be used jointly with the coupling components of the present invention as represented by the formulae (II), (III), (IV), or (V) for the purpose of, for example, controlling proper hue. Any known compound may be used suitably as the additional coupling component, provided that it can form a colored image through its coupling reaction with the diazo compound under a basic condition.

For example, a so-called "active methylene compound", in which a methylene group is linked to a carbonyl group, a phenol derivative, a naphthol derivative, and the like, may be used within a range that agrees with the purpose of the present invention.

Illustrative examples of such compounds include resorcinol, phloroglucinol, sodium 2,3-dihydroxynaphthalene-6-sulfonate, 1-hydroxy-2-naphthoic acid morpholinopropylamide, 1,5-dihydroxynaphthalene, 2,3-dihydroxynapththalene, 2,3-dihydroxy-6-sulfonylnaphthalene, 2-hydroxy-3-naphthoic acid morpholinopropylamide, 2-hydroxy-3-naphthoic acid octylamide, 2-hydroxy-3-naphthoic acid anilide, benzoylacetanilide, 1-phenyl-3-methyl-5-pyrazolone, 1-(2,4,6-trichlorophenyl)-3-anilino-5-pyrazolone, 2-[3-α-(2,4-di-tert-amylphenoxy)butaneamidobenzamide]phenol, 2,4-bis-(benzoylacetamino)toluene, and 1,3-bis-(pivaloylacetaminomethyl)benzene.

Microcapsules preferable for use in the present invention may contain substantially no solvent from a viewpoint of obtaining excellent shelf life. Such microcapsules may be prepared by a process which comprises the steps of:

(1) dissolving a diazonium salt and the same or different compounds which react each other to form a high molecular weight substance into a non-aqueous solvent having a boiling point of from about 40° to 95° C. under normal pressure, (2) emulsifying and dispersing the resulting solution in a hydrophilic protective colloid solution contained in a reaction vessel, and (3) increasing the temperature to distill off the solvent, thereby allowing wall-forming substances to adhere onto the surface of oil globules (the emulsified non-aqueous solution of the diazonium salt and the compounds to form a high molecular weight substance}and to form high molecular weight wall membranes by addition polymerization or condensation polymerization.

The high molecular weight substance which forms the wall of the microcapsules of the present invention may preferably be formed from at least one material selected from polyurethane and polyurea. Examples of the high molecular weight substance include an adduct of tolylenediisocyanate and trimethylolpropane and a condensation product of phenylisocyanate and formaldehyde, etc.

The non-aqueous solvent which is used in the present invention to dissolve the diazonium salt may preferably be at least one compound selected from the group consisting of halogenated hydrocarbons, fatty acid esters, ketones, and ethers, more preferably, methylene chloride, methyl acetate, ethyl acetate, propyl acetate, and butyl acetate.

The same or different compounds which are used in the present invention to form a high molecular weight substance by their mutual reaction and subsequently to form the wall of the microcapsules may preferably be selected from polyurethane and polyurea, and their corresponding monomers may be selected from aromatic or aliphatic isocyanate compounds. The microcapsules in which the diazo compound of the present invention is included may be obtained by polymerizing the compounds and their corresponding monomers. In this instance, the components may be used in such an amount that the mean particle size and wall thickness of the microcapsules become about 0.3 to 12 μm and about 0.01 to 0.3 μm, respectively (about 0.1 to 20 g/m$^2$). The diazo compound may preferably be applied in an amount of from about 0.05 to 5.0 g/m$^2$, more preferably, about 0.05 to 3.0 g/m$^2$.

According to the present invention, organic bases are used to make the reaction system basic at the time of heat development so that the coupling reaction is enhanced. These organic bases may be used alone or as a mixture of two or more. The basic compound may be selected from nitrogen-containing compounds such as tertiary amines, piperidines, piperazines, amidines, formamidines, pyridines, guanidines, morpholines, and the like.

Illustrative examples of preferred basic compounds include: piperazines such as N,N'-bis (3-phenoxy-2-hydroxypropyl) piperazine, N,N'-bis [3-(p-methylphenoxy)-2-hydroxypropyl] piperazine, N,N'-bis [3-(p-methoxyphenoxy)-2-hydroxypropyl] piperazine, N,N'-bis [3-phenylthio-2-hydroxypropyl) piperazine, N,N'-bis [3-(β-naphthoxy)-2-hydroxypropyl) piperazine, N,-3-(β-naphthoxy)-2-hydroxypropyl-N'-methyl piperazine, 1,4-bis {[3-(N-methylpiperazino)-2-hydroxyl]-propyloxy} benzene, and the like; morpholines such as N-[3-(β-naphthoxy)-2-hydroxyl]propyl morpholine, 1,4-bis-[(3-morpholino-2-hydroxy)propyloxy] benzene, 1,3-bis-[(3-morpholino-2-hydroxy)propyloxy] benzene, and the like; piperidines such as N-(3-phenoxy-2-hydroxypropyl) piperidine, N-dodecyl piperidine, and the like; and guanidines such as triphenyl guanidine, tricyclohexyl guanidine, dicyclohexylphenyl guanidine, and the like. Among these basic compounds, the piperazines and the guanidines are more preferable.

In the practice of the present invention, the coupling component and the basic compound may each preferably be used in the range of from about 0.1 to 30 parts by weight, more preferably, about 0.2 to 10 parts by weight, based on one part by weight of the diazo compound.

According to the present invention, a coloring agent may be used in addition to the organic base, in order to enhance the coloring reaction.

As an example of the coloring agent of the present invention, a compound selected from the group consisting of phenol derivatives, naphthol derivatives, alkoxy-substituted benzenes, alkoxy-substituted naththalenes, hydroxyl compounds, amide compounds, and sulfonamide compounds may be added to the sensitive layer, in order to perform heat development quickly and completely at a low energy level. It is considered that a high color density is obtained by the addition of these compounds due to their function to decrease the melting point of the coupling component or the basic compound or to increase the heat transmissibility of the wall of the microcapsules.

The coloring agent of the present invention also includes a heat meltable material. A heat meltable material is a compound which has a melting point of from about 50° to 150° C., so that it is a solid at ordinary temperatures but becomes a liquid when heated and, therefore, it can dissolve the diazo compound, coupling component, or basic compound of the present invention. Illustrative examples of such materials include fatty acid amides, N-substituted fatty acid amides, ketone compounds, urea compounds, esters, and the like.

The coupling component, together with the basic compound and other ingredients, including coloring agents, of the present invention may be used by dispersing the solids in a water soluble high molecular weight substance with sand mill or the like means, but more preferably by emulsifying the solids with a appropriate emulsifying agent. Examples of preferred water soluble high molecular weight substances are the compounds which have been used for the preparation of microcapsules (for instance, those which have been disclosed in JP-A-59-190886). In this instance, each of the coupling component, the basic compound and the coloring agent may be used in an amount of from about 5 to 40% by weight, based on a solution of the water soluble high molecular substance. Preferably, the dispersed or emulsified water soluble high molecular substance may have a particle size of about 10 μm or smaller.

A radical generator (a compound which generates free radicals when exposed to light and is used in photopolymerizable compositions and the like) may be added to the recording material of the present invention for the purpose of reducing the formation of yellow color on the surface of the material after copying. Examples of the radical generator include aromatic ketones, quinones, benzoin, benzoin ethers, azo compounds, organic disulfides, acyloxime esters and the like. The radical generator may be used preferably in an amount of from about 0.01 to 5 parts by weight, based on one part by weight of the diazo compound.

For the purpose of reducing the formation of yellow color, a polymerizable compound having ethylenic unsaturated bonding (hereinafter referred to as "vinyl monomer") may also be useful. A vinyl monomer is a compound containing at least one ethylenically unsaturated bond (a vinyl group, vinylidene group, or the like) in its chemical structure, thus showing chemical properties specific to monomers and prepolymers. Examples of such vinyl monomers include, for instance, unsaturated carboxylic acids and salts thereof, esters of unsaturated carboxylic acids and aliphatic polyhydric alcohols, and amides of unsaturated carboxylic acids and aliphatic polyamine compounds. The vinyl monomer may be used in an amount of from about 0.2 to 20 parts by weight, based on one part by weight of the diazo compound.

The radical generator and vinyl monomer may be used by incorporating them into microcapsules together with the diazo compound.

According to the present invention, citric acid, tartaric acid, oxalic acid, boric acid, phosphoric acid, pyrophosphoric acid, or the like may also be used as an acid stabilizer, in addition to the aforementioned materials.

The recording material of the present invention may be obtained by preparing a coating solution including diazo compound-containing microcapsules, a coupling component, an organic base and other additives, and by subsequently coating and drying the thus prepared solution on a support such as paper, a synthetic resin film, or the like by means of bar coating, blade coating, air knife coating, gravure coating, roll coating, spray coating, dip coating, curtain coating, or the like to obtain a sensitive layer having a solid weight basis of about 0.5 to 30 $g/m^2$, preferably, about 1 to 20 $g/m^2$. According to the recording material of the present invention, the microcapsules, coupling component, base compound, and the like may be contained in a single layer as described above or in separate layers to form a laminate type structure. As another structure of the recording material, the sensitive layer may be laminated on an intermediate layer (for example, a layer as disclosed in JP-A-61-54980), which has been coated on a support in advance.

In regard to the support of the present invention, any of the conventionally used pressure sensitive paper, heat sensitive paper, and paper supports which are used in dry or wet type diazo-type copying paper may be applicable. Also useful as the support are: neutral paper having a pH value of from 5 to 9 which has been treated with a neutral sizing agent such as an alkyl ketene dimer (JP-A-55-14281 corresponding to U.S. Pat. No. 4,255,491); a paper material which satisfies a relationship between the Steckigt degree and meter basis weight and has a Beck smoothness of 90 seconds or more (JP-A-57-116687 corresponding to U.S. Pat. No. 4,416,939); a paper material having an optical surface roughness of 8 μm or less and a thickness of 30 to 150 μm (JP-A-58-136492); a paper material having a density of 0.9 $g/cm^3$ or less and an optical contact ratio of 15% or more (JP-A-58-69091 corresponding to U.S. Pat. No. 4,490,732); a paper material having a capacity to prevent the penetration of a coating solution, which is prepared from pulp that has been treated by beating to obtain a Canadian standard freshness (JIS P8121) of 400 cc or more (JP-A-58-69097 corresponding to U.S. Pat. No. 4,484,205); a paper material in which the color density and resolving power are improved by using a glossy surface of a raw paper material prepared by a Yankee machine as the coating surface (JP-A-58-65695 corresponding to U.S. Pat. No. 4,466,007); and a paper material in which coating properties are improved by treating a raw paper material with a corona discharge (JP-A-59-35985 corresponding to U.S. Pat. No. 4,576,831).

Synthetic resin films for use in the support of the present invention may be selected at will from known materials which have dimensional stability and show no deformation against heating during the development process. Illustrative examples of such films include: polyester films such as polyethylene terephthalate, polybutylene terephthalate, and the like; films of cellulose derivatives, such as cellulose triacetate film and the like; and polyolefin films such as polystyrene film, polypropylene film, and the like. These films may be used alone or as a laminate thereof. The thickness of the support may be in the range of from about 20 to 200 μm.

Either of the following two processes may be employed suitably for the formation of an image on the recording material of the present invention: (1) after forming a latent image by exposing the material using an original (the portions other than the latent image portion being fixed), the latent image portion is heated to form an image; and (2) after obtaining a color image by means of heating with a hot pen, a thermal head, or the like, the portions other than the image portion are fixed by irradiation. Various kinds of fluorescent lamps, xenon lamps, mercury lamps, and the like may be used as the light source for exposure. In this instance, it is preferable to select an emission spectrum which is close to the absorption spectrum of the diazo compound used in the recording material, because the use of such an emission spectrum of the light source makes it possible to fix the portions other than the image forming portion efficiently. In the heat development process of the recording material, a hot pen, a thermal head, infrared radiation, high-frequency wave, a heat block, a heat roller, and the like may be used as the heating means.

The present invention is further described in detail with the following examples by way of illustration and not by way of limitation. All parts, percents, ratios, and the like are by weight unless otherwise stated.

SYNTHESIS EXAMPLE 1

24.6 g of 5-phenyl-4-methoxycarbonyl-cyclohexane-1,3-dione and 10.6 g of triethylamine were dissolved in 100 ml of acetonitrile. With cooling in an ice bath, 12.5 g of pivaloyl chloride was slowly added dropwise to the resulting solution. After completion of the dropwise addition, the resulting mixture was stirred for 1 hour at the same temperature and then poured into 500 ml of water. Thereafter, the thus precipitated crystals were filtered and then subjected to recrystallization with alcohol to obtain 29.5 g of a compound which has been illustratively exemplified as compound (V-8).

(yield=89%, m.p.=115° to 117° C.).

SYNTHESIS EXAMPLE 2

The reaction of Synthesis Example 1 was repeated, except that 9.9 g of methyl chloroformate was used instead of pivaloyl chloride, and 27.4 g of a compound which has been illustratively exemplified as compound (V-9) was obtained.

(yield=90%, m.p.=78° to 79° C.).

SYNTHESIS EXAMPLE 3

The reaction of Synthesis Example 2 was repeated, except that 45.8 g of 5-(2-tetradecyloxyphenyl)-4-methoxycarbonyl-1,3-dione was used instead of 5-phenyl-4-methoxycarbonyl-cyclohexane-1,3-dione, and 43.9 g of a compound which has been illustratively exemplified as compound (V-15) was obtained.

(yield=85%, m.p.=63° to 64° C.).

SYNTHESIS EXAMPLE 4

The reaction of Synthesis Example 2 was repeated, except that 46.0 g of 5-(4-dodecyloxy-3-methoxyphenyl)-4-methoxycarbonyl-1,3-dione was used instead of 5-phenyl-4-methoxycarbonyl-cyclohexane-1,3-dione, and 44.0 g of a compound which has been illustratively exemplified as compound (V-26) was obtained.

(yield=85%, m.p.=79° to 81° C.).

SYNTHESIS EXAMPLE 5

The reaction of Synthesis Example 1 was repeated except that 45.2 g of 5-(2-decyloxy-1-naphthyl)-4-methoxycarbonylcyclohexane-1,3-dione was used instead of 5-phenyl-4-methoxycarbonyl-cyclohexane-1,3-dione, and 11.3 g of N,N-dimethylcarbamic acid chloride was used instead of pivaloyl chloride. As a result, 48.6 g of a compound which has been illustratively exemplified as compound (V-22) was obtained.

(yield=93%, m.p.=79° to 81° C.).

EXAMPLE 1

Preparation of microcapsule solution A of the invention 3.45 parts of 1-dihexylamino-3-hexyloxybenzene-4-diazonium hexafluorophosphate and 18 parts of an addition compound of xylylene diisocyanate and trimethylolpropane (3:1) were added to 10 parts of ethyl acetate, and the mixture was heated at about 40° C. for one hour to dissolve the ingredients. The thus prepared diazo compound solution was mixed with a solution in which 5.2 parts of polyvinyl alcohol was dissolved in 58 parts of water, and the resulting mixture was subjected to emulsification and dispersion at 20° C. using a homogenizer, thereby obtaining an emulsified solution having an average particle size of 2.5 μm. Thereafter, the thus prepared emulsion was mixed with 100 parts of water and heated at 50° C. for 3 hours with stirring to obtain a solution of microcapsules in which the diazo compound was included.

Preparation of coupler/base emulsion B 10 parts of compound (II-2), which has been illustratively exemplified in the foregoing as one of the coupling components of the present invention, 5 parts of triphenyl guanidine and 3 parts of tricresyl phosphate were dissolved in 50 parts of ethyl acetate. The resulting solution was mixed with 200 parts of 15% polyvinyl alcohol aqueous solution and then subjected to emulsification dispersion using a homogenizer. Thereafter, the resulting emulsion was kept at 30° C. to remove ethyl acetate and to obtain the captioned emulsion B. The average particle size of the thus obtained emulsion was found to be 0.5 μm.

Preparation of a recording material of the invention

A coating solution was prepared by mixing 50 parts of the microcapsule solution A with 50 parts of the emulsion B. The coating solution was then applied to a smooth and transparent polyethylene terephthalate film (75 μm in thickness) using a coating bar in such an amount that the dry weight density of the resulting layer was 10 g/m$^2$. Thereafter, the thus applied coating solution was dried at 50° C. for 1 minute to obtain a recording material.

Test for color development and fixation

The recording material obtained above was superposed with a testing original and exposed to a fluorescent lamp which had a maximum emission spectrum at 420 nm for about 5 seconds. In this instance, the testing original was prepared by uniformly painting a black circle of 3 cm in diameter on a sheet of tracing paper with a 2B pencil. Thereafter, an image was obtained by heating the thus exposed recording material for about 3 seconds using a heat block which had been heated to 120° C. Separately from this, another image was obtained by first heating the recording material with a heat block which had been heated to 120° C. for about 3 seconds and then subjecting the resulting material to whole image exposure using a lamp having an absorption maximum of 420 nm for about 10 seconds. Densities of the thus colored portions were measured using a Macbeth densitometer, with the results shown in Table 1.

EXAMPLES 2 to 12

Recording materials were prepared and images were formed on the materials in the same manner as in Example 1, except that each coupler/base emulsion was obtained using the corresponding coupler of the present invention as shown in Table 1, instead of the compound (II-2) as used in Example 1. Densities of the thus colored portions were measured using a Macbeth densitometer, with the results shown in Table 1.

EXAMPLES 13 to 20

Recording materials were prepared and images were formed on the materials in the same manner as in Example 1, except that microcapsule solutions were obtained by using 1-dibutylamino-3-butoxybenzene-4-diazonium hexafluorophosphate (Examples 13, 14, 15 and 16) and 1-dioctylamino-3-octyloxybenzene-4-diazonium hexafluorophosphate (Examples 17, 18, 19 and 20) instead of the 1-dihexylamino-3-hexyloxybenzene-4-diazonium hexafluorophosphate used in Examples 1, 4, 7 and 10. Densities of the thus colored portions were measured using a Macbeth densitometer, with the results shown in Table 1.

COMPARATIVE EXAMPLE 1

Recording materials were prepared and images were formed on the materials in the same manner as in Example 1, except that a coupler/base emulsion was obtained using 1-phenyl-3-octyloxycarbonylpyrazol-5-one instead of the compound (II-2) used in Example 1. Densities of the thus colored portions were measured using a Macbeth densitometer, with the results shown in Table 1.

Changes in the color density were measured using a Macbeth reflection densitometer.

The results of the examination of the developed hues and color densities are shown in Table 1.

TABLE 1

| Density and hues of developed color on each recording material and color densities without and with forced storage | | | | | | | |
|---|---|---|---|---|---|---|---|
| | | | Color density | | | Color density | |
| Example No. | Diazo compound | Coupler compound | Heating after exposure | Exposure after heating | Developed hue | Without forced storage | With forced storage |
| 1 | A* | II-(2) | 1.25 | 1.25 | magenta | 1.26 | 1.25 |
| 2 | A* | II-(9) | 1.22 | 1.22 | magenta | 1.22 | 1.22 |
| 3 | A* | II-(15) | 1.21 | 1.21 | magenta | 1.23 | 1.21 |
| 4 | A* | III-(2) | 1.25 | 1.25 | magenta | 1.25 | 1.16 |
| 5 | A* | III-(9) | 1.22 | 1.22 | magenta | 1.22 | 1.12 |
| 6 | A* | III-(15) | 1.21 | 1.21 | magenta | 1.21 | 1.11 |
| 7 | A* | IV-(2) | 1.25 | 1.25 | magenta | 1.25 | 1.16 |
| 8 | A* | IV-(9) | 1.22 | 1.22 | magenta | 1.22 | 1.12 |
| 9 | A* | IV-(15) | 1.21 | 1.21 | magenta | 1.21 | 1.11 |
| 10 | A* | V-(8) | 1.24 | 1.24 | magenta | 1.24 | 1.14 |
| 11 | A* | V-(15) | 1.25 | 1.25 | magenta | 1.25 | 1.15 |
| 12 | A* | V-(25) | 1.22 | 1.22 | magenta | 1.22 | 1.12 |
| 13 | B* | II-(2) | 1.22 | 1.22 | magenta | 1.24 | 1.23 |
| 14 | B* | III-(2) | 1.21 | 1.21 | magenta | 1.22 | 1.13 |
| 15 | B* | IV-(2) | 1.22 | 1.22 | magenta | 1.22 | 1.13 |
| 16 | B* | V-(8) | 1.21 | 1.21 | magenta | 1.23 | 1.13 |
| 17 | C* | II-(2) | 1.22 | 1.22 | magenta | 1.33 | 1.20 |
| 18 | C* | III-(2) | 1.21 | 1.21 | magenta | 1.21 | 1.10 |
| 19 | C* | IV-(2) | 1.23 | 1.23 | magenta | 1.21 | 1.10 |
| 20 | C* | V-(8) | 1.22 | 1.22 | magenta | 1.22 | 1.12 |
| Comparative 1 | A* | F** | 1.21 | 1.21 | blue purple | 1.21 | 1.12 |
| Comparative 2 | D* | II-(2) | 1.20 | 1.20 | orange red | 1.20 | 1.13 |
| Comparative 3 | D* | III-(2) | 1.20 | 1.20 | orange red | 1.20 | 1.13 |
| Comparative 4 | D* | IV-(2) | 1.20 | 1.20 | orange red | 1.20 | 1.13 |
| Comparative 5 | D* | V-(8) | 1.20 | 1.20 | orange red | 1.20 | 1.13 |
| Comparative 6 | E* | II-(2) | 1.19 | 1.19 | orange red | 1.19 | 0.50 |
| Comparative 7 | E* | III-(2) | 1.19 | 1.19 | orange red | 1.19 | 0.50 |
| Comparative 8 | E* | IV-(2) | 1.19 | 1.19 | orange red | 1.19 | 0.50 |
| Comparative 9 | E* | V-(8) | 1.19 | 1.19 | orange red | 1.19 | 0.50 |

A*: 1-dihexylamino-3-hexyloxybenzene-4-diazonium hexafluorophosphate
B*: 1-dibutylamino-3-butoxybenzene-4-diazonium hexafluorophosphate
C*: 1-dioctylamino-3-octyloxybenzene-4-diazonium hexafluorophosphate
D*: 1-morpholino-3-butoxybenzene-4-diazonium hexafluorophosphate
E*: 1-morpholino-2,5-dibutoxybenzene-4-diazonium hexafluorophosphate
F**: 1-phenyl-3-octyloxycarbonylpyrazol-5-one

COMPARATIVE EXAMPLES 2 to 9

Recording materials were prepared and images were formed on the materials in the same manner as in Example 1, except that microcapsule solutions were obtained by using 1-morpholino-3-butoxybenzene-4-diazonium hexafluorophosphate (Comparative Examples 2, 3, 4 and 5) and 1-morpholino-2,5-dibutoxybenzene-4-diazonium hexafluorophosphate (Comparative Examples 6, 7, 8 and 9) instead of the 1-dihexylamino-3-hexyloxybenzene-4-diazonium hexafluorophosphate used in Examples 1, 4, 7 and 10. Densities of the thus colored portions were measured using a Macbeth densitometer, with the results shown in Table 1.

Next, the developed hues of the thus obtained recording materials were measured, and the shelf lives of the materials were compared.

Measurement of developed hues was carried out by visual observation of the formed images.

For the examination of the shelf lives, one sheet from a pair of heat-sensitive recording sheets was stored at room temperature, while the other sheet was subjected to forced storage for 72 hours at a temperature of 60° C. and a humidity of 30% RH, and the differences in the density of the colors on these stored sheets after development using a hot plate (at 120° C. for about 3 seconds) were compared.

As is evident from these results, the magenta hue of interest can be developed and a heat-sensitive recording sheet having excellent shelf life can be obtained by the combined use of the diazo compound and the coupling component of the present invention.

While the invention has been described in detail and with reference to specific embodiments thereof, it will be apparent to one skilled in the art that the various changes and modifications can be made therein without departing from the spirit and scope thereof.

What is claimed is:

1. A light- and heat-sensitive recording material comprising a support having thereon a recording layer comprising:

(A) a 1-substituted amino-3-alkoxybenzene-4-diazonium salt;

(B) a coupling component selected from the group consisting of (a) compounds prepared from 3-cyclohexenone, and represented by formula (III):

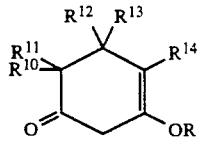

(III)

wherein $R^{10}$, $R^{11}$, $R^{12}$ and $R^{13}$, which may be the same or different, each represents a hydrogen atom, an alkyl group, an aryl group, an aralkyl group, a substituted amino group, a substituted carbonyl group, or a cyano group; $R^{14}$ represents a substituted carbonyl group or a cyano group; and R represents an alkyl group, an aryl group, a substituted carbonyl group, a substituted sulfonyl group, a cationic group, or a substituted silyl group, (b) compounds prepared from 2-cyclohexenone and represented by formula (IV):

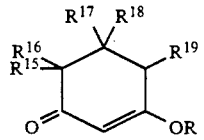

(IV)

wherein $R^{15}$, $R^{16}$, $R^{17}$ and $R^{18}$, which may be the same or different, each represents a hydrogen atom, an alkyl group, an aryl group, an aralkyl group, a substituted amino group, a substituted carbonyl group, or a cyano group; $R^{19}$ represents a substituted carbonyl group or a cyano group; and R represents an alkyl group, an aryl group, a substituted carbonyl group, a substituted sulfonyl group, cationic group, or a substituted silyl group, and (c) compounds prepared from 2-cyclohexenone and represented by formula (V):

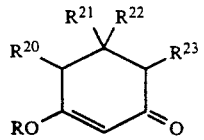

V wherein $R^{20}$, $R^{21}$ and $R^{22}$, which may be the same or different, each represents a hydrogen atom, an alkyl group, an aryl group, an aralkyl group, a substituted amino group, a substituted carbonyl group, or a cyano group; $R^{23}$ represents a substituted carbonyl group or a cyano group; and R is an alkyl group, an aryl group, a substituted carbonyl group, a substituted sulfonyl group, a cationic group, or a substituted silyl group; and (c) an organic base.

2. The light- and heat-sensitive recording material as in claim 1, wherein said 1-substituted amino-3-alkoxybenzene-4-diazonium salt is a compound represented by formula (I):

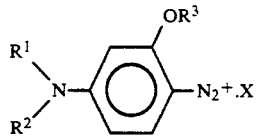

(I)

wherein $R^1$, $R^2$, and $R^3$, which may be the same or different, each represents an unsubstituted or substituted alkyl group, aralkyl group, or aryl group, and $X^-$ represents an acid anion.

3. The light- and heat-sensitive recording material as in claim 2, wherein $R^1$, $R^2$, and $R^3$ contain a total of at least twelve carbon atoms.

4. The light- and heat-sensitive recording material as in claim 1, wherein said diazonium salt contains a substituted amino group and an alkoxy group having a total of at least 12 carbon atoms.

5. The light- and heat-sensitive recording material as in claim 1, wherein said diazonium salt has a melting point of from about 30° to 200° C.

6. The light- and heat-sensitive recording material as in claim 5, wherein said diazonium salt has a melting point of from about 50° to 150° C.

7. The light- and heat-sensitive recording material as in claim 1, wherein said diazonium salt is present in said recording layer in an amount ranging from about 0.02 to 3 g/m$^2$.

8. The light- and heat-sensitive recording material as in claim 7, wherein said diazonium salt is present in said recording layer in an amount ranging from about 0.1 to 2 g/m$^2$.

9. The light- and heat-sensitive recording material as in claim 1, wherein said diazonium salt is present in microcapsules.

10. The light- and heat-sensitive recording material as in claim 9, wherein said diazonium salt has a solubility of about 5% or more in a non-aqueous solvent and about 1% or less in water, said non-aqueous solvent being used to dissolve said diazonium salt when said microcapsules are prepared.

11. The light- and heat-sensitive recording material as in claim 9, wherein said microcapsules have walls prepared from at least one high molecular weight compound selected from the group consisting of polyurethane and polyurea.

12. The light- and heat-sensitive recording material as in claim 9, wherein said microcapsules have an average particle size of from about 0.3 to 12 μm and a wall thickness of from about 0.01 to 0.3 μm.

13. The light- and heat-sensitive recording material as in claim 1, wherein said coupling component is a compound prepared from 3-cyclohexenone and is represented by formula (III):

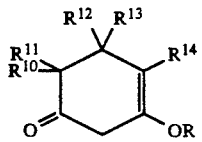

(III)

wherein $R^{10}$, $R^{11}$, $R^{12}$ and $R^{13}$, which may be the same or different, each represents a hydrogen atom, an alkyl group, an aryl group, an aralkyl group, a substituted amino group, a substituted carbonyl group, or a cyano group; $R^{14}$ represents a substituted carbonyl group or a cyano group; and R represents an alkyl group, an aryl group, a substituted carbonyl group, a substituted sulfonyl group, a cationic group, or a substituted silyl group.

14. The light- and heat-sensitive recording material as in claim 1, wherein said coupling component is a compound prepared from 2-cyclohexenone and is represented by formula (IV):

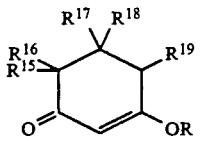

(IV)

wherein $R^{15}$, $R^{16}$, $R^{17}$ and $R^{18}$, which may be the same or different, each represents a hydrogen atom, an alkyl group, an aryl group, an aralkyl group, a substituted amino group, a substituted carbonyl group, or a cyano group; $R^{19}$ represents a substituted carbonyl group or a cyano group; and R represents an alkyl group, an aryl group, a substituted carbonyl group, a substituted sulfonyl group, a cationic group, or a substituted silyl group.

15. The light- and heat-sensitive recording material as in claim 1, wherein said coupling component is a compound prepared from 2-cyclohexenone and is represented by formula (V):

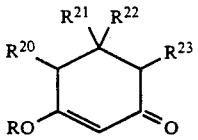

(V)

wherein $R^{20}$, $R^{21}$ and $R^{22}$, which may be the same or different, each represents a hydrogen atom, an alkyl group, an aryl group, an aralkyl group, a substituted amino group, a substituted carbonyl group, or a cyano group; $R^{23}$ represents a substituted carbonyl group or a cyano group; and R is an alkyl group, an aryl group, a substituted carbonyl group, a substituted sulfonyl group, a cationic group, or a substituted silyl group.

16. The light- and heat-sensitive recording material as in claim 1, wherein said coupling component is present in an amount of from about 0.1 to 30 parts by weight, based on one part by weight of said diazo compound.

17. The light- and heat-sensitive recording material as in claim 1, wherein said organic base is at least one organic base selected from the group consisting of tertiary amidines, piperidines, piperazines, amidines, formamidines, and pyridines.

18. The light- and heat-sensitive recording material as in claim 1, wherein said organic base is present in an amount of from about 0.1 to 30 parts by weight, based on one part by weight of said diazo compound.

19. The light- and heat-sensitive recording material as in claim 1, wherein said recording layer is coated on said support in an amount of from about 2.5 to 30 g/m$^2$.

* * * * *